US011510443B1

(12) United States Patent
Richardson et al.

(10) Patent No.: US 11,510,443 B1
(45) Date of Patent: Nov. 29, 2022

(54) SHOWER APPAREL

(71) Applicants: Tyra Monique Richardson, Charlotte, NC (US); Herbert Lee Richardson, Charlotte, NC (US)

(72) Inventors: Tyra Monique Richardson, Charlotte, NC (US); Herbert Lee Richardson, Charlotte, NC (US)

( * ) Notice: Subject to any disclaimer, the term of this patent is extended or adjusted under 35 U.S.C. 154(b) by 247 days.

(21) Appl. No.: 16/984,230

(22) Filed: Aug. 4, 2020

Related U.S. Application Data

(60) Provisional application No. 62/890,720, filed on Aug. 23, 2019.

(51) Int. Cl.
*A41D 7/00* (2006.01)
*A41D 1/06* (2006.01)

(52) U.S. Cl.
CPC ..... *A41D 7/005* (2013.01); *A41D 1/06* (2013.01)

(58) Field of Classification Search
CPC ..... A41D 7/005; A41D 13/1281; A41D 13/1254; A41D 7/006; A41D 7/008; A41D 7/00; A41D 1/089; A41D 1/215; A41B 9/02; A41B 9/026
See application file for complete search history.

(56) References Cited

U.S. PATENT DOCUMENTS 1,962,984 A * 6/1934 Crego ..... A41D 7/00 D2/714
2,050,410 A * 8/1936 Baer ..... A61F 5/40 602/69
2,112,893 A * 4/1938 Harwood ..... A41B 9/02 450/95
2,248,204 A * 7/1941 Snider ..... A41C 3/06 450/114
2,544,840 A * 3/1951 Kowatsch ..... A41D 7/005 2/67
3,166,764 A * 1/1965 Stedman ..... A41B 9/02 2/403
3,207,155 A * 9/1965 Cullen ..... A41B 9/026 2/403
4,815,145 A * 3/1989 Chow ..... A41D 7/00 2/72
4,951,321 A * 8/1990 Mortensen ..... A41B 9/001 2/919
5,093,935 A * 3/1992 Countee, Jr. ..... A41B 9/02 2/403
5,182,815 A * 2/1993 Young ..... A41D 1/089 2/406
5,303,424 A * 4/1994 Cromartie ..... A41D 7/005 2/DIG. 1
5,694,643 A * 12/1997 Fujiwara ..... A41D 7/008 2/114

(Continued)

*Primary Examiner* — Heather Mangine
(74) *Attorney, Agent, or Firm* — Kyle A. Fletcher, Esq.

(57) ABSTRACT

The shower apparel is a garment. The shower apparel is configured for use by a client. The shower apparel is configured for use with a community shower. The shower apparel is worn by the client when the client uses a community shower for cleaning. The shower apparel shields the sensitive parts of the client's body from the view of others in the community shower. The shower apparel incorporates a loin wear and a navel cover. The loin wear shields the loin of the client's body from the view of others in the community shower. The navel cover shields the navel of the client's body from the view of others in the community shower.

15 Claims, 9 Drawing Sheets

(56) References Cited

U.S. PATENT DOCUMENTS 5,819,323 A * 10/1998 Edenfield ..... A41B 9/02 2/403
5,884,340 A * 3/1999 Chen ..... A41D 7/006 89/36.01
5,920,914 A * 7/1999 Dempsey ..... A41B 9/02 2/403
6,035,439 A * 3/2000 Chin ..... A41B 9/08 2/408
6,041,445 A * 3/2000 Davitt ..... A61F 5/449 2/400
6,173,449 B1 * 1/2001 Osterrath ..... A41D 7/005 2/69
6,182,297 B1 * 2/2001 Duren ..... A41D 13/0575 450/99
6,185,741 B1 * 2/2001 Kehoe ..... A41D 7/00 2/69
6,412,119 B1 * 7/2002 Robles ..... A41B 9/026 2/400
6,425,140 B1 * 7/2002 Vitches ..... A41B 9/02 2/403
6,901,607 B1 * 6/2005 Elwell ..... A41B 9/023 2/403
7,389,547 B1 * 6/2008 Wiens ..... A41D 1/089 2/227
8,141,173 B2 * 3/2012 Sterling ..... A41D 7/00 2/70
8,479,320 B2 * 7/2013 Swafford ..... A41D 1/065 2/78.2
8,522,362 B1 * 9/2013 Stones ..... A41D 7/00 450/33
8,632,414 B1 * 1/2014 Rippberger ..... A63B 69/3608 473/226
2002/0053102 A1 * 5/2002 Vartanyan ..... A41D 7/005 2/403
2002/0087137 A1 * 7/2002 Christoffel ..... A41D 7/00 604/385.01
2004/0083538 A1 * 5/2004 Thomas ..... A41D 27/201 2/400
2004/0177427 A1 * 9/2004 Pedrick ..... A41F 7/00 2/82
2005/0125872 A1 * 6/2005 Hobbs ..... A41D 7/00 2/67
2009/0094723 A1 * 4/2009 Doda, Jr. ..... A41D 7/00 340/572.1
2012/0272427 A1 * 11/2012 Scozzafava ..... A41D 7/00 2/69
2012/0311758 A1 * 12/2012 Nicholson ..... A41D 27/20 2/400
2016/0278438 A1 * 9/2016 Polidan ..... A41B 9/026
2016/0316833 A1 * 11/2016 Bruce ..... A41B 9/04
2017/0020203 A1 * 1/2017 Alexander ..... A41B 9/02
2017/0215487 A1 * 8/2017 Chou ..... A41B 9/02
2018/0228232 A1 * 8/2018 Fisher ..... A41D 27/02
2019/0029344 A1 * 1/2019 Moore ..... A41F 9/025
2019/0053547 A1 * 2/2019 Butler ..... A41D 1/22
2019/0069617 A1 * 3/2019 Farrell ..... A41D 7/005
2019/0125008 A1 * 5/2019 King ..... A41D 7/008
2019/0274374 A1 * 9/2019 Marconi ..... A41D 1/065
2019/0328047 A1 * 10/2019 Beach ..... A61F 13/496
2019/0364992 A1 * 12/2019 Thomas ..... A41D 13/1245
2020/0015526 A1 * 1/2020 Brown, Sr. ..... A61F 13/49006
2020/0196680 A1 * 6/2020 Whitt ..... A61F 13/505
2021/0100681 A1 * 4/2021 Miles ..... A41B 9/14

* cited by examiner

SHOWER APPAREL

CROSS REFERENCES TO RELATED APPLICATIONS

This non-provisional application claims priority under 35 USC 119(e) to U.S. provisional application U.S. 62/890,720 filed on Aug. 23, 2019 by the inventor: Herbert Lee Richardson. This non-provisional application claims United States provisional application U.S. 62/890,720 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of apparel including outwear, more specifically, a bathing gown. (A41D7/00)

SUMMARY OF INVENTION

The shower apparel is a garment. The shower apparel is configured for use by a client. The shower apparel is configured for use with a community shower. The shower apparel is worn by the client when the client uses a community shower for cleaning. The shower apparel shields the sensitive parts of the client's body from the view of others in the community shower. The shower apparel comprises a loin wear and a navel cover. The loin wear shields the loin of the client's body from the view of others in the community shower. The navel cover shields the navel of the client's body from the view of others in the community shower.

These together with additional objects, features and advantages of the shower apparel will be readily apparent to those of ordinary skill in the art upon reading the following detailed description of the presently preferred, but nonetheless illustrative, embodiments when taken in conjunction with the accompanying drawings.

In this respect, before explaining the current embodiments of the shower apparel in detail, it is to be understood that the shower apparel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shower apparel.

It is therefore important that the claims be regarded as including such equivalent construction insofar as they do not depart from the spirit and scope of the shower apparel. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
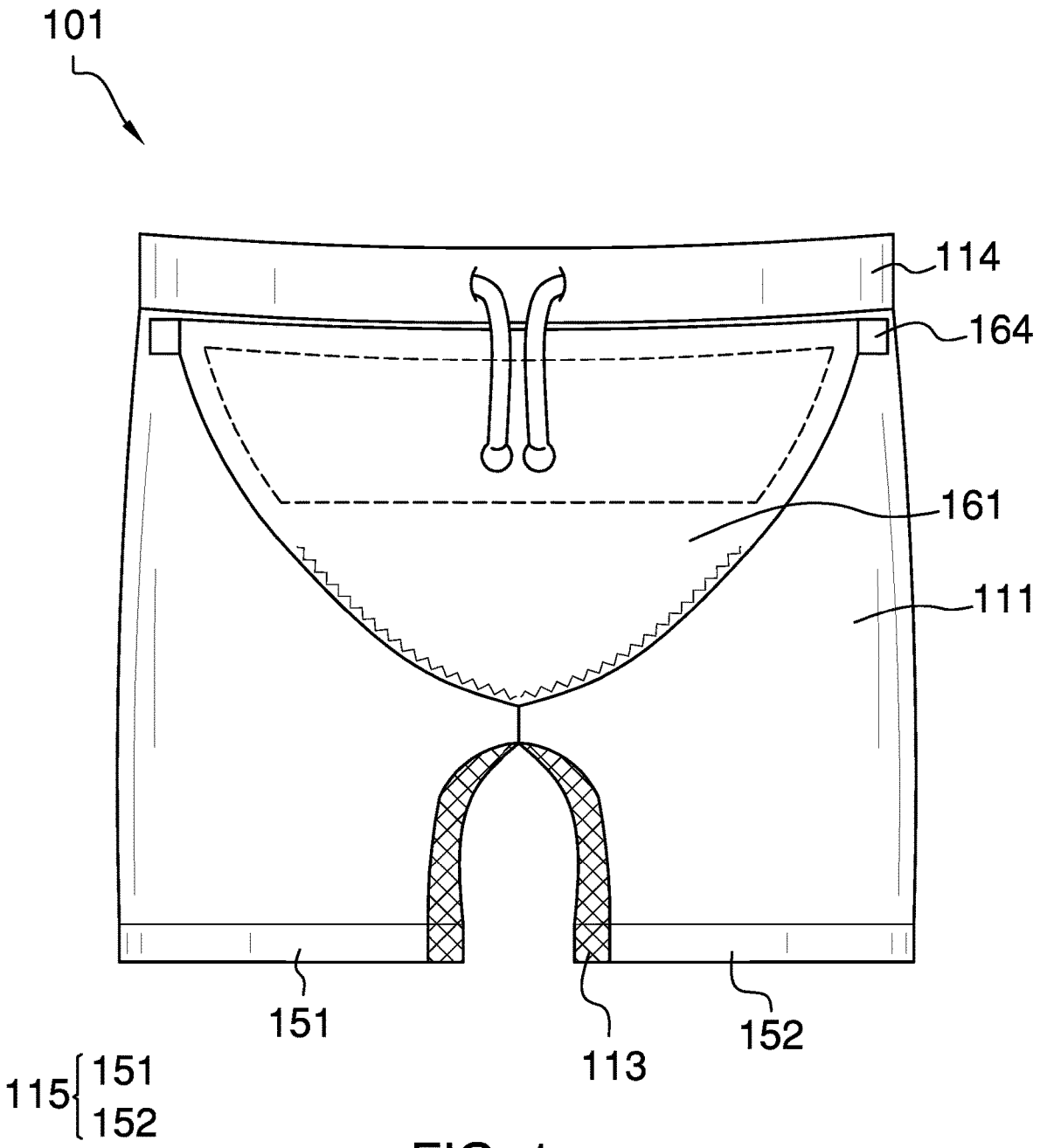
FIG. 1 is a front view of an embodiment of the disclosure.
Figure 2:
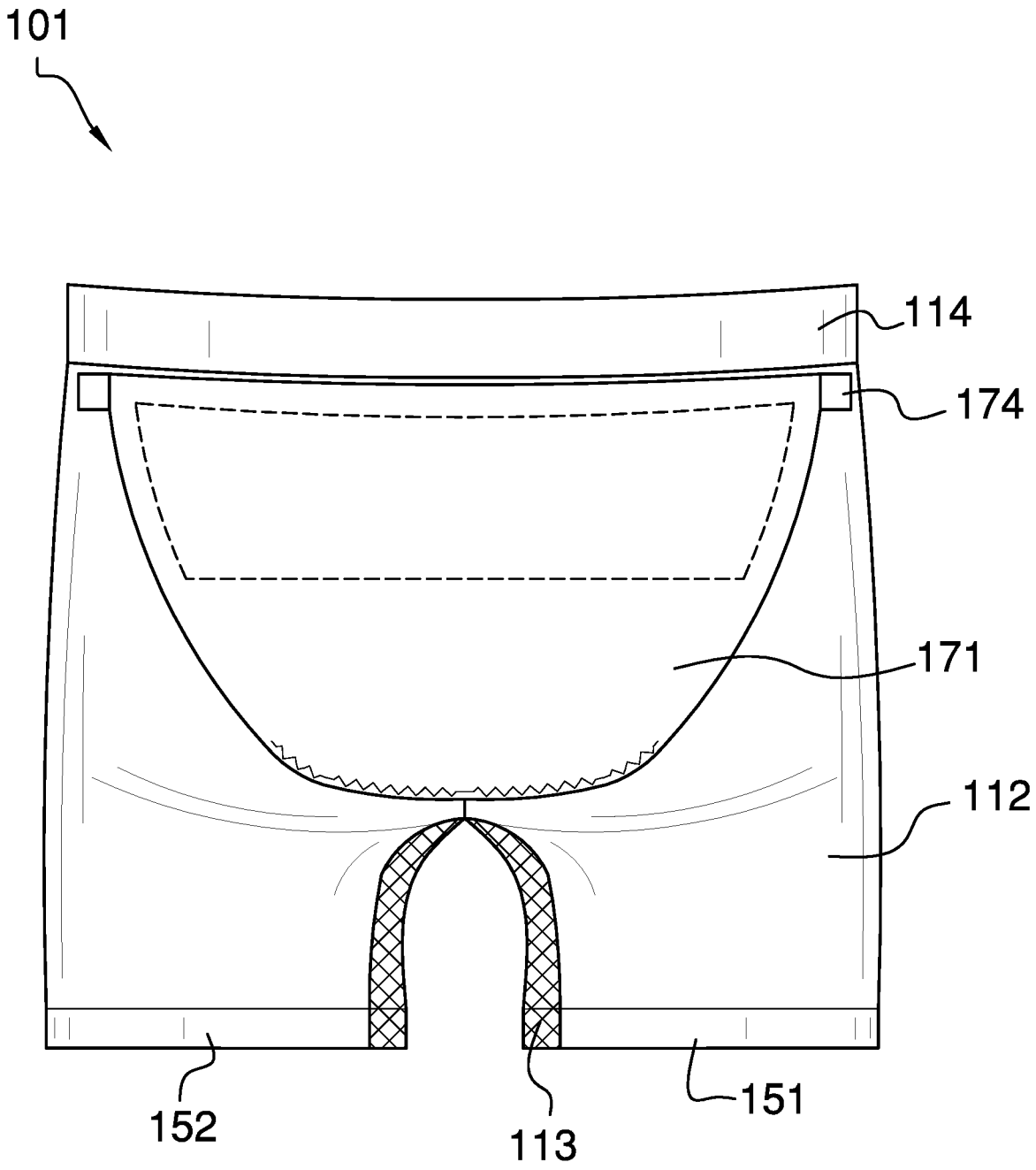
FIG. 2 is a rear view of an embodiment of the disclosure.
Figure 3:
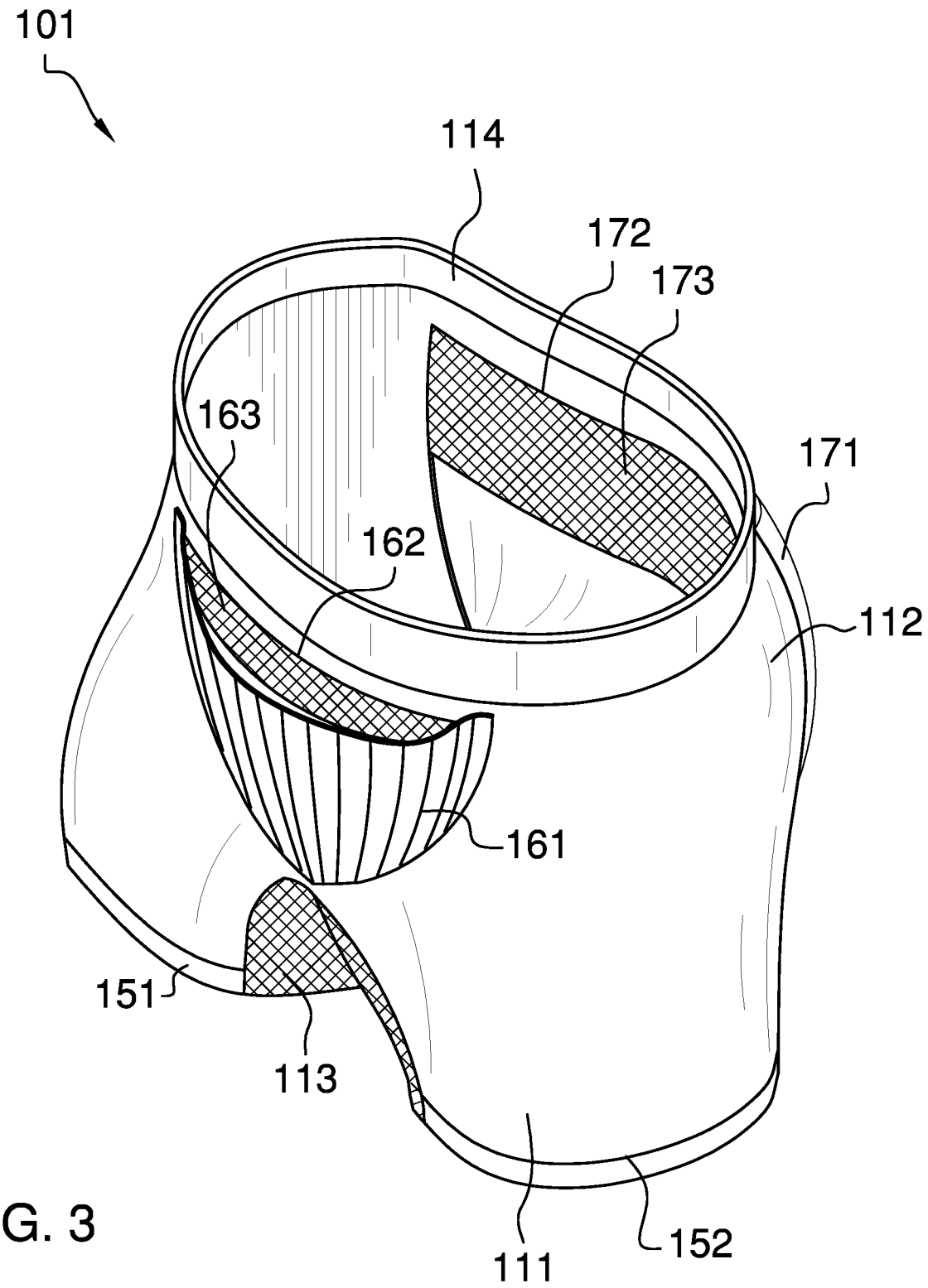
FIG. 3 is a perspective view of an embodiment of the disclosure.
Figure 4:
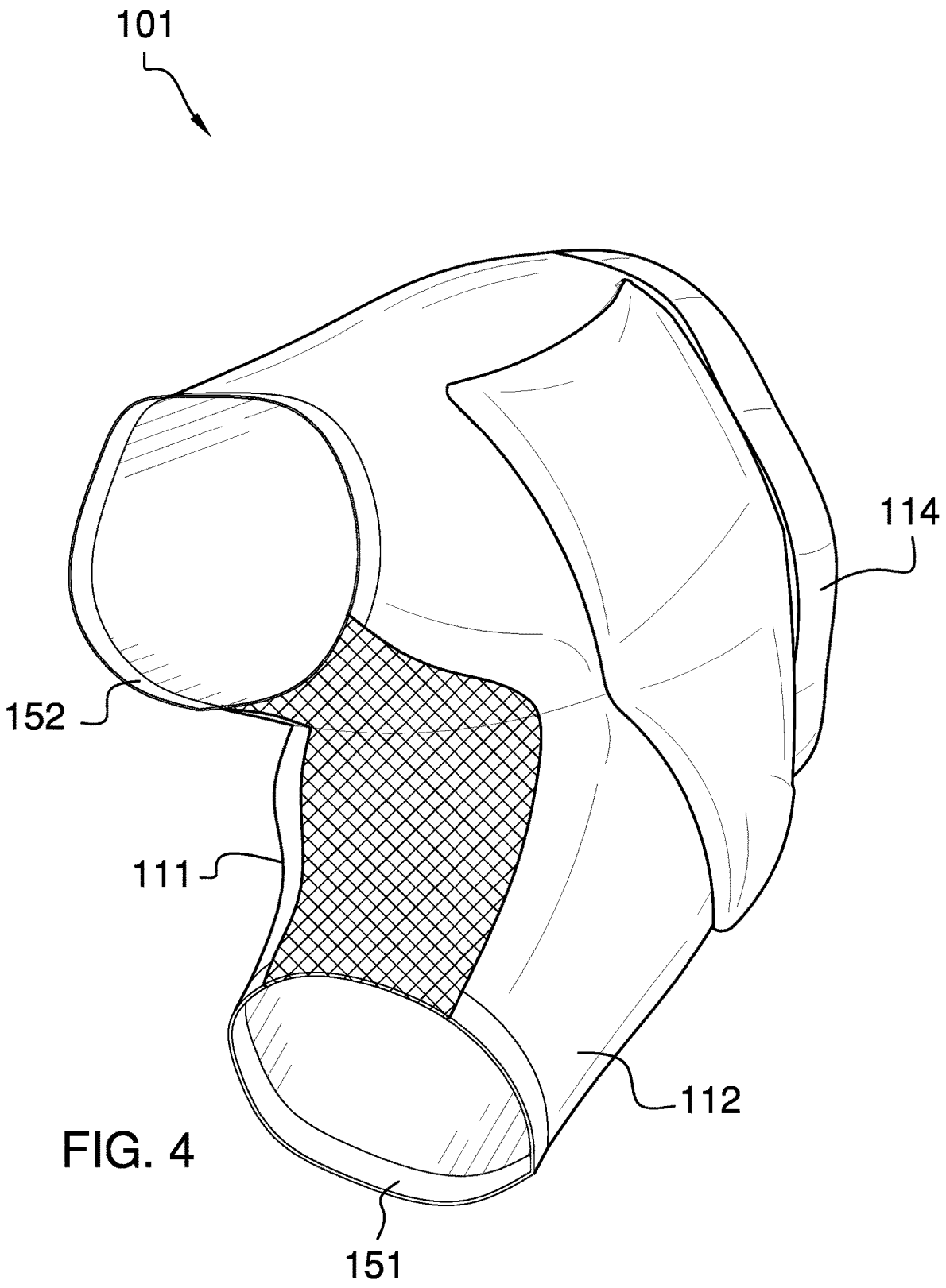
FIG. 4 is a reverse perspective view of an embodiment of the disclosure.
Figure 5:
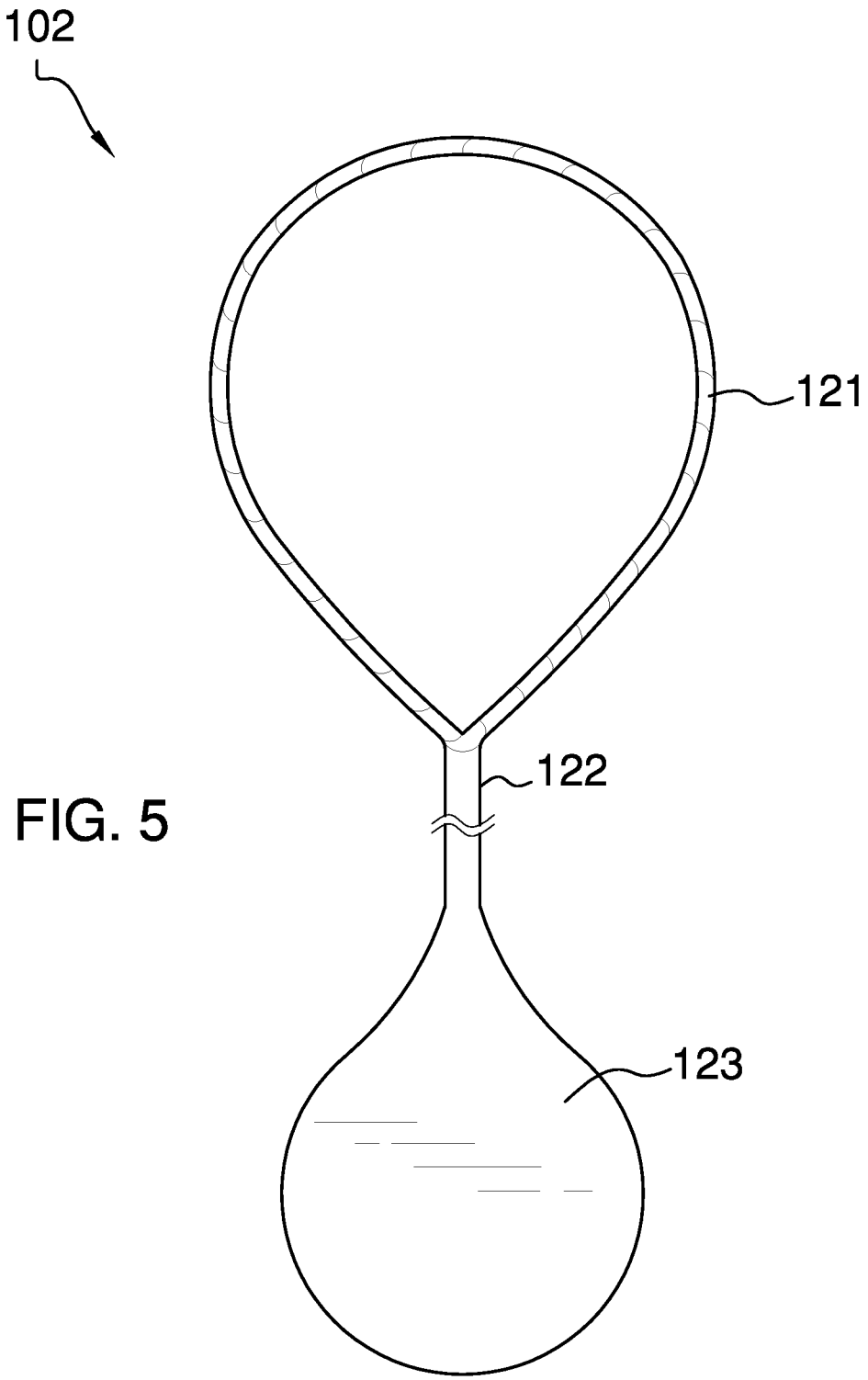
FIG. 5 is a front view of an embodiment of the disclosure.
Figure 6:
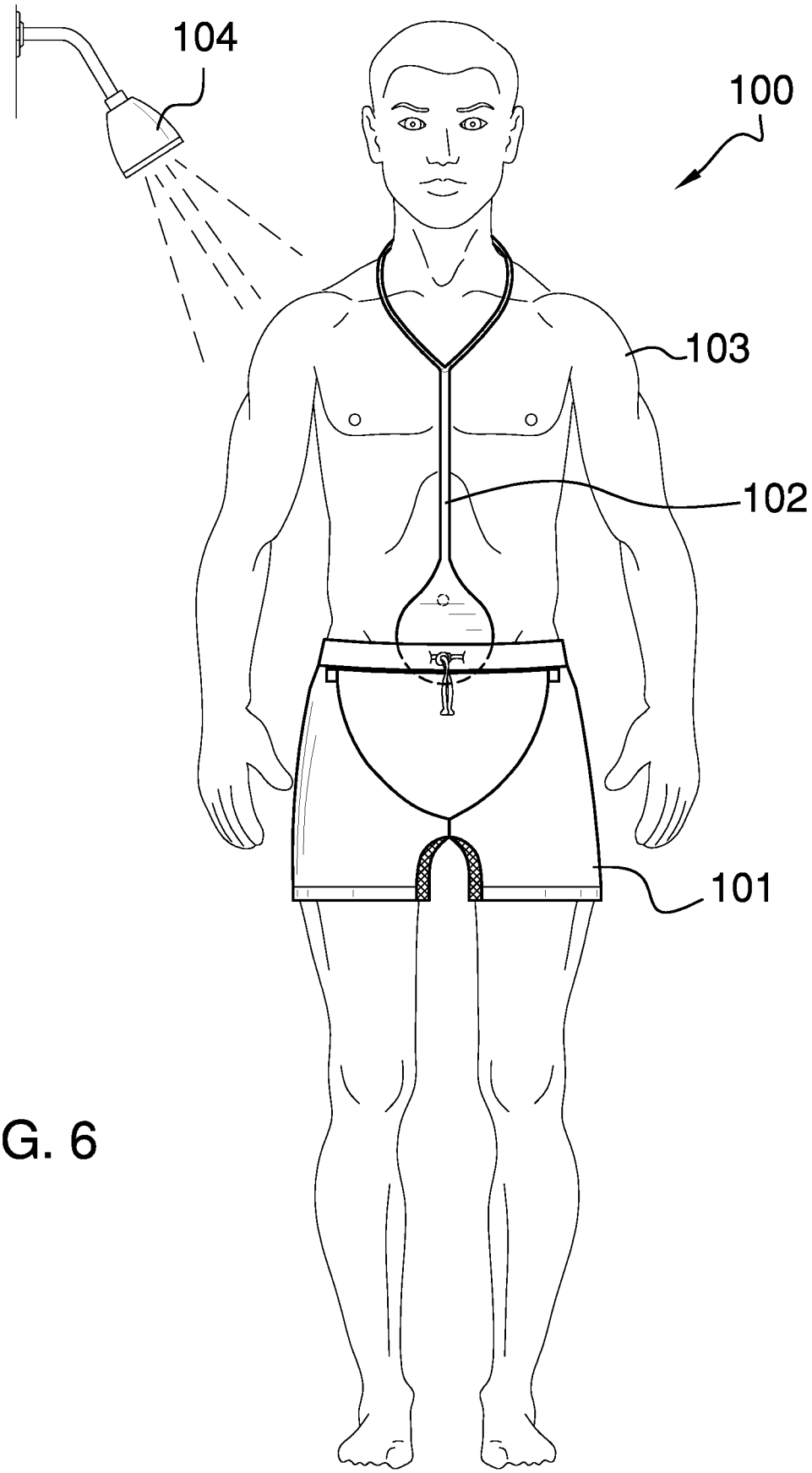
FIG. 6 is an in-use view of an embodiment of the disclosure.
Figure 7:
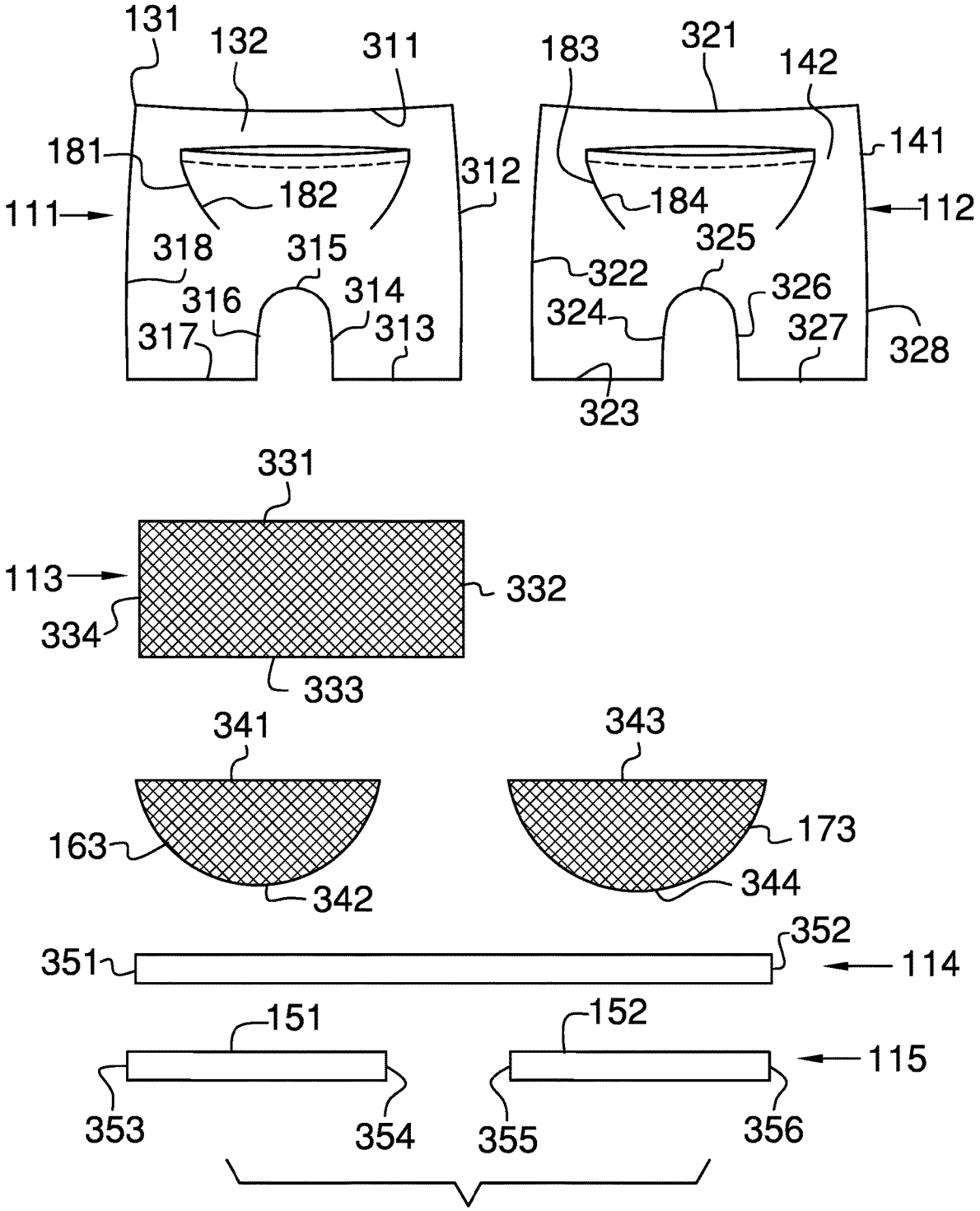
FIG. 7 is a detail view of an embodiment of the disclosure.
Figure 8:
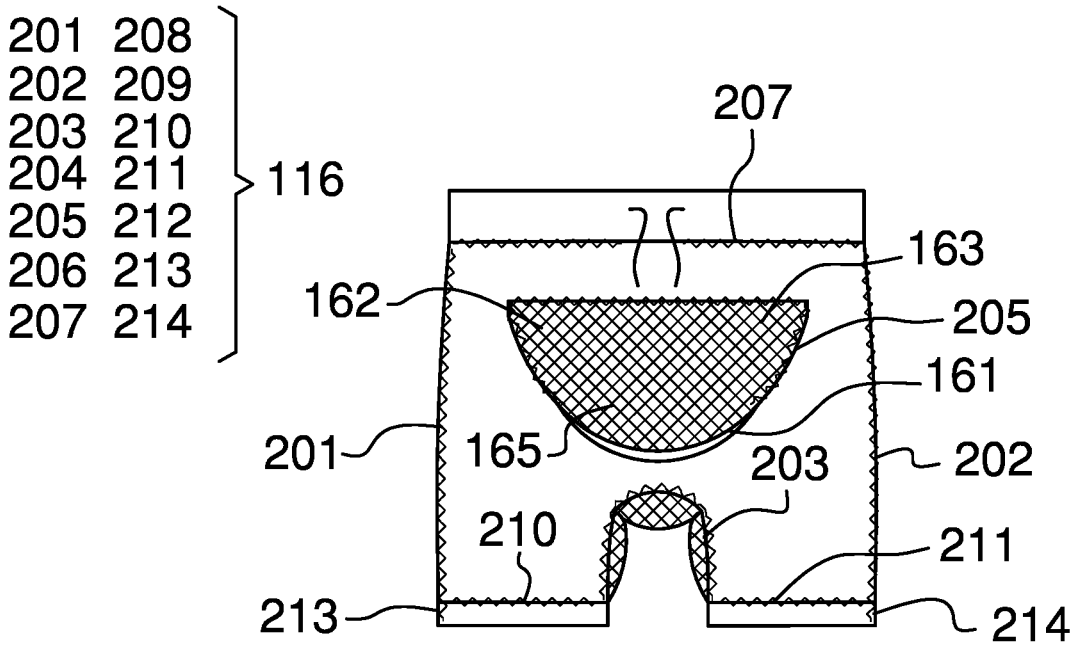
FIG. 8 is a detail view of an embodiment of the disclosure.
Figure 9:
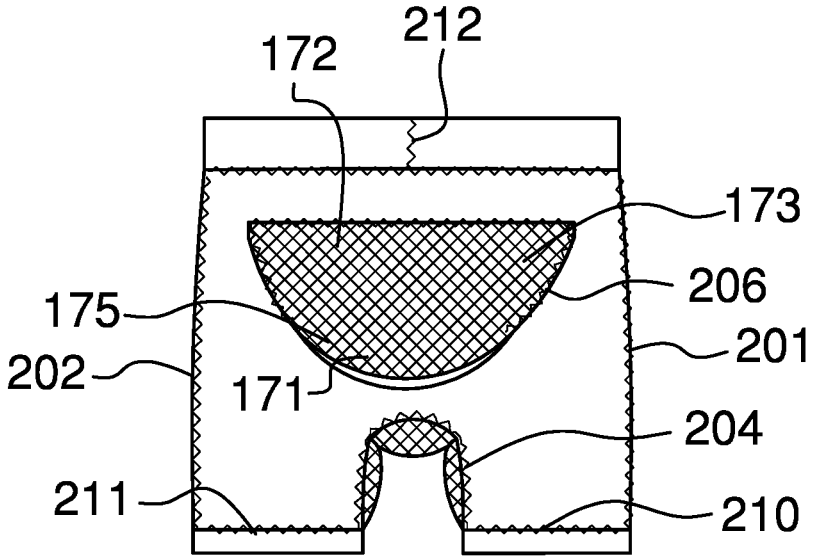
FIG. 9 is a detail view of an embodiment of the disclosure.
Figure 10:
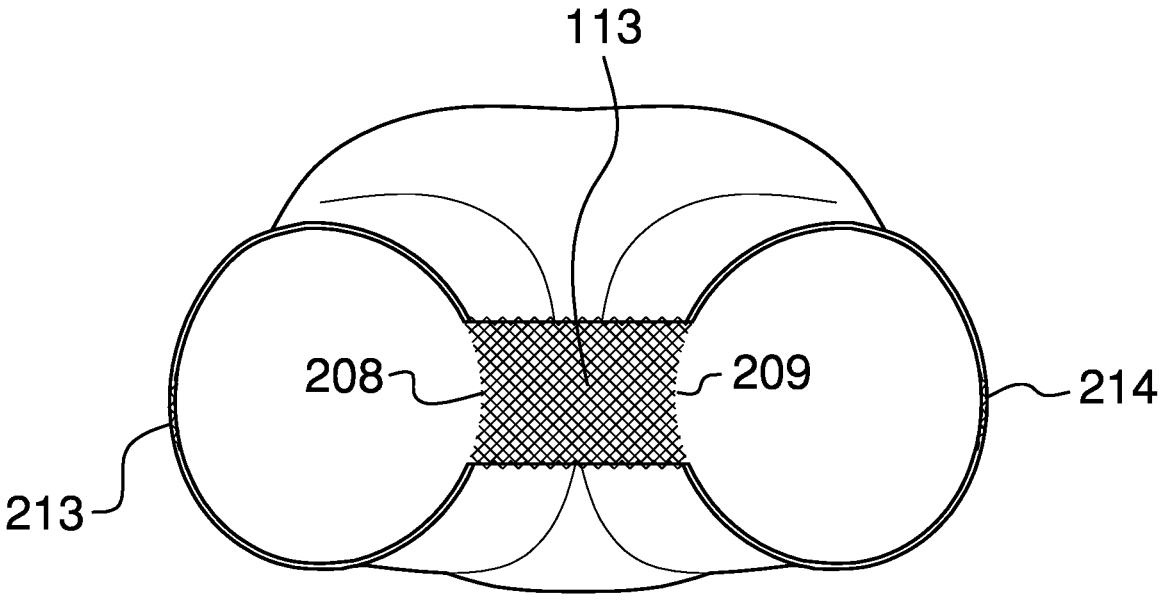
FIG. 10 is a detail view of an embodiment of the disclosure.

Detailed reference will now be made to one or more potential embodiments of the disclosure, which are illustrated in FIGS. 1 through 10.

The shower apparel 100 (hereinafter invention) is a garment. The invention 100 is configured for use by a client 103. The invention 100 is configured for use with a community shower 104. The invention 100 is worn by the client 103 when the client 103 uses a community shower 104 for cleaning. The invention 100 shields the sensitive parts of the client's 103 body from the view of others in the community shower 104. The invention 100 comprises a loin wear 101 and a navel cover 102. The loin wear 101 shields the loin of the client's 103 body from the view of others in the community shower 104. The navel cover 102 shields the navel of the client's 103 body from the view of others in the community shower 104. The client 103 and the community shower 104 is defined elsewhere in this disclosure.

The navel cover 102 is a garment. The navel cover 102 is worn by the client 103. The navel cover 102 covers the navel of the client 103. The navel cover 102 comprises a collar 121, a cord 122, and a medallion 123. The cord 122 attaches the collar 121 to the medallion 123.

The collar 121 is a textile based structure. The collar 121 is defined elsewhere in this disclosure. The collar 121 has a ring shape. The collar 121 fits around the neck of the client 103. The collar 121 secures the cord 122 and the medallion 123 to the client 103. The cord 122 is a textile based structure. The cord 122 suspends the medallion 123 from the collar 121. The medallion 123 is a disk-shaped structure. The medallion 123 is sized such that the medallion 123 covers the navel of the client 103. The span of the length of the cord 122 is selected such that the medallion 123 hangs at a position directly over the navel of the client 103.

The loin wear 101 is a garment. The loin wear 101 is worn by the client 103. The loin wear 101 covers the loin region of the client 103. The terms loin and loin wear 101 are further defined elsewhere in this disclosure. The loin wear 101 comprises an anterior panel 111, a posterior panel 112, an inferior panel 113, a waistband 114, a plurality of leg bands 115, and a plurality of seams 116. The plurality of seams 116 interconnect the anterior panel 111, the posterior panel 112, the inferior panel 113, the waistband 114, and the plurality of leg bands 115 to assemble the loin wear 101.

The anterior panel 111 is a sheeting structure. The anterior panel 111 is a textile based structure. The anterior panel 111 is the portion of the loin wear 101 that covers the anterior and lateral surfaces of the loin region of the client 103. The anterior panel 111 comprises an anterior panel 111 sheeting 131 and an anterior panel 111 port 132. The anterior panel 111 port 132 is formed in the anterior panel 111 sheeting 131.

The anterior panel 111 sheeting 131 is a sheeting structure. The anterior panel 111 sheeting 131 is a textile based structure. The anterior panel 111 sheeting 131 has a rectilinear shape. The anterior panel 111 sheeting 131 forms the physical structure of the anterior panel 111 that covers the anterior and lateral surfaces of the loin region of the client 103. The anterior panel 111 sheeting 131 comprises a first edge 311, a second edge 312, a third edge 313, a fourth edge 314, a fifth edge 315, a sixth edge 316, a seventh edge 317, and an eighth edge 318.

The first edge 311 forms a vertex with the eighth edge 318. The first edge 311 forms a vertex with the second edge 312. The second edge 312 forms a vertex with the third edge 313. The third edge 313 forms a vertex with the fourth edge 314. The fourth edge 314 forms a vertex with the fifth edge 315. The fifth edge 315 forms a vertex with the sixth edge 316. The sixth edge 316 forms a vertex with the seventh edge 317. The seventh edge 317 forms a vertex with the eighth edge 318.

The anterior panel 111 port 132 is a port that is formed in the anterior panel 111 sheeting 131. The anterior panel 111 port 132 has an open position and a closed position. In the open position, the anterior panel 111 port 132 forms an aperture that allows for the flow of water into the loin wear 101. The water that flows through the anterior panel 111 port 132 flows over the anterior and lateral surfaces of the loin region of the client 103. The anterior panel 111 port 132 secures into a closed position that allows for increased modesty when the client 103 is not taking a shower. The anterior panel 111 port 132 comprises an anterior panel 111 port 132 flap 161, an anterior panel 111 port 132 aperture 162, an anterior panel 111 port 132 mesh cover 163, and an anterior panel 111 hook and loop fastener 164.

The anterior panel 111 port 132 flap 161 is a flap that is formed in the anterior panel 111 sheeting 131. The anterior panel 111 port 132 aperture 162 is an aperture that is formed through the faces of the anterior panel 111 sheeting 131. The anterior panel 111 port 132 flap 161 and the anterior panel 111 port 132 aperture 162 are formed but cutting a slit through the anterior panel 111 sheeting 131. The anterior panel 111 port 132 flap 161 is formed in the shape of a semi-circle. The anterior panel 111 port 132 aperture 162 is formed in the shape of a semi-circle. The anterior panel 111 port 132 flap 161 forms the structure that blocks the visibility through the anterior panel 111 port 132 aperture 162. The anterior panel 111 port 132 flap 161 blocks the visibility through the anterior panel 111 port 132 aperture 162 when the anterior panel 111 sheeting 131 is in a closed position. The anterior panel 111 port 132 flap 161 folds away from the anterior panel 111 port 132 aperture 162 when the anterior panel 111 sheeting 131 is in an open position.

The anterior panel 111 port 132 flap 161 further comprises an anterior panel 111 port 132 living hinge 165 and a first raw edge 181. The anterior panel 111 port 132 aperture 162 further comprises a second raw edge 182.

The anterior panel 111 port 132 living hinge 165 is a physical connection that leaves the anterior panel 111 port 132 flap 161 attached to the anterior panel 111 sheeting 131 such that the anterior panel 111 port 132 flap 161 can rotate relative to the anterior panel 111 sheeting 131. The anterior panel 111 port 132 living hinge 165 is formed as a living hinge. The living hinge is defined elsewhere in this disclosure. The first raw edge 181 is the raw edge of the slit that forms the anterior panel 111 port 132 that forms the perimeter of the anterior panel 111 port 132 aperture 162. The second raw edge 182 is the raw edge of the slit that forms the anterior panel 111 port 132 that forms the perimeter of the anterior panel 111 port 132 flap 161.

The anterior panel 111 port 132 mesh cover 163 is a mesh textile. The anterior panel 111 port 132 mesh cover 163 is cut in the shape of a semi-circle. The anterior panel 111 port 132 mesh cover 163 is geometrically similar to the anterior panel 111 port 132 flap 161 and the anterior panel 111 port 132 aperture 162. The anterior panel 111 port 132 mesh cover 163 forms a netting structure that covers the anterior panel 111 port 132 aperture 162. The anterior panel 111 port 132 mesh cover 163 prevents solid objects from falling into the loin wear 101 when the loin wear 101 is in an open position. The anterior panel 111 port 132 mesh cover 163 further comprises a twenty-first edge 341 and a twenty-second edge 342. The twenty-first edge 341 is the linear edge of the anterior panel 111 port 132 mesh cover 163. The twenty-second edge 342 is the curved edge of the anterior panel 111 port 132 mesh cover 163.

The anterior panel 111 hook and loop fastener 164 is a fastening structure. The anterior panel 111 hook and loop fastener 164 attaches the anterior panel 111 port 132 flap 161 over the anterior panel 111 port 132 aperture 162 when the loin wear 101 is in the closed position. The anterior panel 111 hook and loop fastener 164 is a hook and loop fastener. The hook and loop fastener is defined elsewhere in this disclosure.

The posterior panel 112 is a sheeting structure. The posterior panel 112 is a textile based structure. The posterior panel 112 is the portion of the loin wear 101 that covers the posterior and lateral surfaces of the loin region of the client 103. The posterior panel 112 comprises a posterior panel 112 sheeting 141 and a posterior panel 112 port 142. The posterior panel 112 port 142 is formed in the posterior panel 112 sheeting 141.

The posterior panel 112 sheeting 141 is a sheeting structure. The posterior panel 112 sheeting 141 is a textile based structure. The posterior panel 112 sheeting 141 has a rectilinear shape. The posterior panel 112 sheeting 141 forms the physical structure of the posterior panel 112 that covers the posterior and lateral surfaces of the loin region of the client 103. The posterior panel 112 sheeting 141 comprises a ninth edge 321, a tenth edge 322, an eleventh edge 323, a twelfth edge 324, a thirteenth edge 325, a fourteenth edge 326, a fifteenth edge 327, and a sixteenth edge 328.

The ninth edge 321 forms a vertex with the sixteenth edge 328. The ninth edge 321 forms a vertex with the tenth edge 322. The tenth edge 322 forms a vertex with the eleventh edge 323. The eleventh edge 323 forms a vertex with the twelfth edge 324. The twelfth edge 324 forms a vertex with the thirteenth edge 325. The thirteenth edge 325 forms a vertex with the fourteenth edge 326. The fourteenth edge 326 forms a vertex with the fifteenth edge 327. The fifteenth edge 327 forms a vertex with the sixteenth edge 328.

The posterior panel 112 port 142 is a port that is formed in the posterior panel 112 sheeting 141. The posterior panel 112 port 142 has an open position and a closed position. In the open position, the posterior panel 112 port 142 forms an aperture that allows for the flow of water into the loin wear 101. The water that flows through the posterior panel 112 port 142 flows over the posterior and lateral surfaces of the loin region of the client 103. The posterior panel 112 port 142 secures into a closed position that allows for increased modesty when the client 103 is not taking a shower. The posterior panel 112 port 142 comprises a posterior panel 112 port 142 flap 171, a posterior panel 112 port 142 aperture 172, a posterior panel 112 port 142 mesh cover 173, and a posterior panel 112 hook and loop fastener 174.

The posterior panel 112 port 142 flap 171 is a flap that is formed in the posterior panel 112 sheeting 141. The posterior panel 112 port 142 aperture 172 is an aperture that is formed through the faces of the posterior panel 112 sheeting 141. The posterior panel 112 port 142 flap 171 and the posterior panel 112 port 142 aperture 172 are formed but cutting a slit through the posterior panel 112 sheeting 141. The posterior panel 112 port 142 flap 171 is formed in the shape of a semi-circle. The posterior panel 112 port 142 aperture 172 is formed in the shape of a semi-circle. The posterior panel 112 port 142 flap 171 forms the structure that blocks the visibility through the posterior panel 112 port 142 aperture 172. The posterior panel 112 port 142 flap 171 blocks the visibility through the posterior panel 112 port 142 aperture 172 when the posterior panel 112 sheeting 141 is in a closed position. The posterior panel 112 port 142 flap 171 folds away from the posterior panel 112 port 142 aperture 172 when the posterior panel 112 sheeting 141 is in an open position.

The posterior panel 112 port 142 flap 171 further comprises a posterior panel 112 port 142 living hinge 175 and a third raw edge 183. The posterior panel 112 port 142 aperture 172 further comprises a fourth raw edge 184.

The posterior panel 112 port 142 living hinge 175 is a physical connection that leaves the posterior panel 112 port 142 flap 171 attached to the posterior panel 112 sheeting 141 such that the posterior panel 112 port 142 flap 171 can rotate relative to the posterior panel 112 sheeting 141. The posterior panel 112 port 142 living hinge 175 is formed as a living hinge. The living hinge is defined elsewhere in this disclosure. The third raw edge 183 is the raw edge of the slit that forms the posterior panel 112 port 142 that forms the perimeter of the posterior panel 112 port 142 aperture 172. The fourth raw edge 184 is the raw edge of the slit that forms the posterior panel 112 port 142 that forms the perimeter of the posterior panel 112 port 142 flap 171.

The posterior panel 112 port 142 mesh cover 173 is a mesh textile. The posterior panel 112 port 142 mesh cover 173 is cut in the shape of a semi-circle. The posterior panel 112 port 142 mesh cover 173 is geometrically similar to the posterior panel 112 port 142 flap 171 and the posterior panel 112 port 142 aperture 172. The posterior panel 112 port 142 mesh cover 173 forms a netting structure that covers the posterior panel 112 port 142 aperture 172. The posterior panel 112 port 142 mesh cover 173 prevents solid objects from falling into the loin wear 101 when the loin wear 101 is in an open position. The posterior panel 112 port 142 mesh cover 173 further comprises a twenty-third edge 343 and a twenty-fourth edge 344. The twenty-third edge 343 is the linear edge of the posterior panel 112 port 142 mesh cover 173. The twenty-fourth edge 344 is the curved edge of the posterior panel 112 port 142 mesh cover 173.

The posterior panel 112 hook and loop fastener 174 is a fastening structure. The posterior panel 112 hook and loop fastener 174 attaches the posterior panel 112 port 142 flap 171 over the posterior panel 112 port 142 aperture 172 when the loin wear 101 is in the closed position. The posterior panel 112 hook and loop fastener 174 is a hook and loop fastener. The hook and loop fastener is defined elsewhere in this disclosure.

The inferior panel 113 is a sheeting structure. The inferior panel 113 is a textile based structure. The inferior panel 113 is a mesh textile. The inferior panel 113 is the portion of the loin wear 101 that covers the inferior surfaces of the loin region of the client 103. The mesh structure of the inferior panel 113 allows water to flow freely out of the loin wear 101 during a shower. The inferior panel 113 further comprises a seventeenth edge 331, an eighteenth edge 332, a nineteenth edge 333, and a twentieth edge 334. The seventeenth edge 331 forms a vertex with the twentieth edge 334. The seventeenth edge 331 forms a vertex with the eighteenth edge 332. The eighteenth edge 332 forms a vertex with the nineteenth edge 333. The nineteenth edge 333 forms a vertex with the twentieth edge 334.

The waistband 114 is a textile based structure. The waistband 114 is a webbing structure. The waistband 114 has a quick cord structure. The waistband 114 binds the loin wear 101 to the client 103. The waistband 114 further comprises a first end 351 and a second end 352. The first end 351 is the edge of the waistband 114 with the least span of length. The second end 352 is the edge of the waistband 114 that is distal from the first end 351.

Each of the plurality of leg bands 115 is a textile based structure. Each of the plurality of leg bands 115 is an elastic webbing. The elastic webbing is defined elsewhere in this disclosure. Each of the plurality of leg bands 115 attaches to the anterior panel 111, the posterior panel 112, and the inferior panel 113. The plurality of leg bands 115 bind the loin wear 101 to the leg of the client 103.

Each of the plurality of leg bands 115 acts as a spring. Specifically, when a force is applied to both ends of each of the plurality of leg bands 115 in a direction parallel to the major axis of the selected leg bands, the applied force elongates the span of the end to end length the plurality of leg bands 115 in the direction parallel to the center axis of the disk structure of each of the plurality of leg bands 115. The elasticity of the plurality of leg bands 115 creates a force that opposes the displacement created by the applied force. The elasticity of the plurality of leg bands 115 returns the plurality of leg bands 115 to return to its relaxed shape. When an elongated leg band selected from the plurality of leg bands 115 is wrapped around a leg of the client 103, the leg of the client 103 will prevent the selected leg band from returning to its relaxed shape. In this circumstance, each of the plurality of leg bands 115 will apply a force projecting radially away from the major axis of the selected leg band and through the lateral face of the plurality of leg bands 115 and against the leg of the client 103 that binds the loin wear 101 to the leg of the client 103.

The plurality of leg bands 115 further comprises a first elastic webbing 151 and a second elastic webbing 152. The first elastic webbing 151 is an elastic textile structure. The first elastic webbing 151 is formed an elastic webbing. The first elastic webbing 151 secures the loin wear 101 to a leg of the client 103. The second elastic webbing 152 is an elastic textile structure. The second elastic webbing 152 is formed an elastic webbing. The second elastic webbing 152 secures the loin wear 101 to a leg of the client 103.

The first elastic webbing 151 further comprises a third end 353 and a fourth end 354. The second elastic webbing 152 further comprises a fifth end 355 and a sixth end 356. The third end 353 is the edge of the first elastic webbing 151 with the least span of length. The fourth end 354 is the edge of the first elastic webbing 151 that is distal from the third end 353. The fifth end 355 is the edge of the second elastic webbing 152 with the least span of length. The sixth end 356 is the edge of the second elastic webbing 152 that is distal from the fifth end 355.

Each of the plurality of seams 116 forms an attachment that is used to assemble the anterior panel 111, the posterior panel 112, the inferior panel 113, the waistband 114, and the plurality of leg bands 115 into the loin wear 101. The plurality of seams 116 comprises a first seam 201, a second seam 202, a third seam 203, a fourth seam 204, a fifth seam 205, a sixth seam 206, a seventh seam 207, an eighth seam 208, a ninth seam 209, a tenth seam 210, an eleventh seam 211, a twelfth seam 212, a thirteenth seam 213, and a fourteenth seam 214.

The first seam 201 is a sewn seam. The first seam 201 attaches the anterior panel 111 to the posterior panel 112. The second seam 202 is a sewn seam. The second seam 202 attaches the anterior panel 111 to the posterior panel 112. The third seam 203 is a sewn seam. The third seam 203 attaches the inferior panel 113 to the anterior panel 111 and the posterior panel 112.

The fourth seam 204 is a sewn seam. The fourth seam 204 attaches the inferior panel 113 to the anterior panel 111 and the posterior panel 112. The fifth seam 205 is a sewn seam. The fifth seam 205 attaches the anterior panel 111 port 132 to the anterior panel 111. The sixth seam 206 is a sewn seam. The sixth seam 206 attaches the posterior panel 112 port 142 to the posterior panel 112.

The seventh seam 207 is a sewn seam. The seventh seam 207 attaches the waistband 114 to the anterior panel 111 and the posterior panel 112. The eighth seam 208 is a sewn seam. The eighth seam 208 attaches the inferior panel 113 to the anterior panel 111 and the posterior panel 112. The ninth seam 209 is a sewn seam. The ninth seam 209 attaches the inferior panel 113 to the anterior panel 111 and the posterior panel 112.

The tenth seam 210 is a sewn seam. The tenth seam 210 attaches the first elastic webbing 151 to the anterior panel 111 and the posterior panel 112. The eleventh seam 211 is a sewn seam. The eleventh seam 211 attaches the second elastic webbing 152 to the anterior panel 111 and the posterior panel 112.

The twelfth seam 212 is a sewn seam. The twelfth seam 212 attaches the waistband 114 to itself to form a loop. The thirteenth seam 213 is a sewn seam. The thirteenth seam 213 attaches the first elastic webbing 151 to itself to form a loop. The fourteenth seam 214 is a sewn seam. The fourteenth seam 214 attaches the second elastic webbing 152 to itself to form a loop.

The following ten paragraphs describe the assembly of the invention 100.

The first seam 201 attaches the eighth edge 318 of the anterior panel 111 sheeting 131 to the sixteenth edge 328 of the posterior panel 112 sheeting 141. The second seam 202 attaches the second edge 312 of the anterior panel 111 sheeting 131 to the tenth edge 322 of the posterior panel 112 sheeting 141.

The third seam 203 attaches the nineteenth edge 333 of the inferior panel 113 to the fourth edge 314 of the anterior panel 111 sheeting 131. The third seam 203 attaches the nineteenth edge 333 of the inferior panel 113 to the fifth edge 315 of the anterior panel 111 sheeting 131. The third seam 203 attaches the nineteenth edge 333 of the inferior panel 113 to the sixth edge 316 of the anterior panel 111 sheeting 131.

The fourth seam 204 attaches the seventeenth edge 331 of the inferior panel 113 to the twelfth edge 324 of the posterior panel 112 sheeting 141. The fourth seam 204 attaches the seventeenth edge 331 of the inferior panel 113 to the thirteenth edge 325 of the posterior panel 112 sheeting 141. The fourth seam 204 attaches the seventeenth edge 331 of the inferior panel 113 to the fourteenth edge 326 of the posterior panel 112 sheeting 141.

The fifth seam 205 attaches the anterior panel 111 port 132 mesh cover 163 to the first raw edge 181 of the anterior panel 111 port 132 aperture 162. The sixth seam 206 attaches the posterior panel 112 port 142 mesh cover 173 to the third raw edge 183 of the posterior panel 112 port 142 aperture 172.

The seventh seam 207 attaches the face of the waistband 114 to the first edge 311 of the anterior panel 111 sheeting 131. The seventh seam 207 attaches the face of the waistband 114 to the ninth edge 321 of the anterior panel 111 sheeting 131.

The eighth seam 208 attaches the face of the twentieth edge 334 of the inferior panel 113 to the seventh edge 317 of the anterior panel 111 sheeting 131. The eighth seam 208 attaches the face of the twentieth edge 334 of the inferior panel 113 to the fifteenth edge 327 of the posterior panel 112 sheeting 141.

The ninth seam 209 attaches the face of the eighteenth edge 332 of the inferior panel 113 to the third edge 313 of the anterior panel 111 sheeting 131. The ninth seam 209 attaches the face of the eighteenth edge 332 of the inferior panel 113 to the eleventh edge 323 of the posterior panel 112 sheeting 141.

The tenth seam 210 attaches the face of the first elastic webbing 151 to the seventh edge 317 of the anterior panel 111 sheeting 131. The tenth seam 210 attaches the face of the first elastic webbing 151 to the fifteenth edge 327 of the posterior panel 112 sheeting 141.

The eleventh seam 211 attaches the face of the second elastic webbing 152 to the third edge 313 of the anterior panel 111 sheeting 131. The eleventh seam 211 attaches the face of the second elastic webbing 152 to the eleventh edge 323 of the posterior panel 112 sheeting 141.

The twelfth seam 212 attaches the face of the first end 351 of the waistband 114 to the second end 352 of the waistband 114. The thirteenth seam 213 attaches the face of the third end 353 of the first elastic webbing 151 to the fourth end 354 of the first elastic webbing 151. The fourteenth seam 214 attaches the face of the fifth end 355 of the second elastic webbing 152 to the sixth end 356 of the second elastic webbing 152.

The following definitions were used in this disclosure:

Anterior: As used in this disclosure, anterior is a term that is used to refer to the front side or direction of a structure. When comparing two objects, the anterior object is the object that is closer to the front of the structure.

Bind: As used in this disclosure, to bind is a verb that means to tie or secure a first object to a second object using a strap, cord or webbing.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Client: As used in this disclosure, a client is an individual who is designated to receive the services of the disclosure at bar.

Closed Position: As used in this disclosure, a closed position refers to a movable barrier structure that is in an orientation that prevents passage through a port or an aperture. The closed position is often referred to as an object being "closed." Always use orientation.

Collar: As used in this disclosure, a collar is a ring like device that is placed around an object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Coronal Plane: As used in this disclosure, the coronal plane refers to a reference plane that bisects an anterior surface and posterior surface. The coronal plane is also referred to as the lateral plane.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Distal: As used in this disclosure, distal refers to a directional sense or location of the body. Specifically, distal refers to a first object or a side of a first object that is distal from the medial axis or more proximal to from the side of the body relative to a second object or side of a second object.

Drawstring: As used in this disclosure, a drawstring is a cord, tape, or a webbing that is contained within a channel that is used to fasten or cinch a textile based object such as an item of apparel of a textile covering. Generally, the channel and cord are formed as a single textile component (in the form of a tape that is often marketed commercially "Quick Cord") that is sewn as a single unit into the textile based object after which the cord is released within the channel.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Elastic Yarn: As used in this disclosure, an elastic yarn is a yarn formed from elastomeric materials.

Flap: As used in this disclosure, a flap is a piece of material that is hinged or otherwise attached to a surface using one side such that the piece of material hangs in such a way as to cover a hole in the surface.

Flexure Bearing: As used in this disclosure, a flexure bearing is a thin and flexible material that is used to attach, or bind, a first object to a second object such that the first object can rotate in a controlled direction relative to the second object.

Flexible: As used in this disclosure, flexible refers to an object or material that will deform when a force is applied to it but that will not necessarily return to its original shape when the deforming force is removed.

Form Factor: As used in this disclosure, the term form factor refers to the size and shape of an object.

Garment: As used in this disclosure, a garment is a textile based structure that is used to cover an individual. Clothes, clothing, and apparel are synonyms for garment.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Inferior: As used in this disclosure, inferior refers to a directional sense or location of the body. Specifically, inferior refers to an object or a side of an object that is proximal to the feet or distal from the head of the body.

Lateral: As used in this disclosure, lateral refers to a directional sense or location of the body. Specifically, lateral refers to an object or a side of an object that is proximal to the side or that is distal from the medial axis of the body.

Living Hinge: As used in this disclosure, refers to a single object that is formed out of flexible material that is divided into a first segment, a second segment and the living hinge. The flexible nature of the flexible material allow the living hinge to be flexed in the manner of a hinge allowing the first segment to rotate relative to the second hinge. The living hinge is a form of a flexure bearing. A material that is formed with a series of parallel living hinges is referred to as a kerf bending. A kerf bending formed in a plate allows the plate to be bent into a curved shape.

Loin: As used in this disclosure, the loin refers to a region of the human body that comprises the pelvis, the buttocks, and the adjacent reproductive organs.

Loin Wear: As used in this disclosure, loin wear refers to underclothing that is intended to be worn over the loin region with the occasional exception of the buttocks. Commonly used synonyms for loin wear include, but are not limited to, bikini bottoms, boxer briefs, boxers, briefs, calzones, drawers, French cut, g string, knickers, loincloth, panties, panty, shorts, skivvies, thong, trunks, underpants, undies, and unmentionables.

Major and Minor Axes: As used in this disclosure, the major and minor axes refer to a pair of perpendicular axes that are defined within a structure. The length of the major axis is always greater than or equal to the length of the minor axis. The major axis forms the longest symmetric bifurcation of the structure. The major and minor axes intersect at the center of the structure. The major axis is always parallel or perpendicular to an edge of a rectangular or rectilinear structure.

Medial: As used in this disclosure, medial refers to a directional sense or location of the body. Specifically, medial refers to a first object or a side of a first object that is closer to the medial axis or more distal from the side of the body relative to a second object or side of a second object.

Medial Axis: As used in this disclosure, the medial axis is the center line of the body as the line is drawn from the head to the foot. When two objects are compared relative to the medial axis, the object closer to the medial axis is referred to as the medial object and the object distal from the medial axis is referred to as the lateral object.

Mesh: As used in this disclosure, the term mesh refers to an openwork fabric made from threads, yarns, cords, wires, or lines that are woven, knotted, or otherwise twisted or intertwined at regular intervals. Synonyms for mesh include net. A mesh structure formed from metal bars or wires is often referred to as a grate.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Port: As used in this disclosure, a port is an aperture formed in an object that allows fluid to flow through the boundary of the object.

Posterior: As used in this disclosure, posterior is a term that is used to refer to the side of an object that is distal or in the opposite direction of the anterior side. When comparing two items, the posterior item is the item that is distal from the anterior of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Private: As used in this disclosure, the term private refers to the limitation of use of an object to a one or more individual. The term privacy refers to maintaining an object or individual in a location where the object or individual can be neither observed nor disturbed.

Raw Edge: As used in this disclosure, a raw edge refers to one of two edges that are formed when a slit is formed in an object. The one or more ends of the slit are called the termination points.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Relaxed Shape: As used in this disclosure, a structure is considered to be in its relaxed state when no shear, strain, or torsional forces are being applied to the structure.

Ring: As used in this disclosure, a ring is term that is used to describe a disk-like structure through which an aperture is formed. Rings are often considered loops.

Sagittal Plane: As used in this disclosure, the sagittal plane refers to a plane that is perpendicular to the both the coronal (or lateral) plane and the transverse plane.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, a laser seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Shower: As used in this disclosure, a shower is a mechanical structure that generates a spray of water used by a client for cleaning. The shower is typically maintained in an enclosed space that provides privacy. A community shower refers to one or more showers that do not provide for the privacy of the client.

Slit: As used in this disclosure, a slit is a long narrow cut or opening that is formed in or through an object.

Spray: As used in this disclosure, a spray is a plurality of liquid drops dispersed in a gas.

Spray Nozzle: As used in this disclosure, a spray nozzle is a device that receives liquid under pressure and disperses that liquid into the atmosphere as a spray.

Superior: As used in this disclosure, superior refers to a directional sense or location of the body. Specifically, superior refers to an object or a side of an object that is distal from the feet or proximal to the head of the body.

Textile: As used in this disclosure, a textile is a material that is woven, knitted, braided or felted. Synonyms in common usage for this definition include fabric and cloth. The two surfaces of the textile with the greatest surface area are called the faces of the textile.

Transverse Plane: As used in this disclosure, a transverse plane is a plane that divides an object into a superior section and an inferior section. In a person the transverse plane would be perpendicular to the medial axis of a body.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

Yarn: As used in this disclosure, a yarn is continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A modesty garment comprising a loin wear;

wherein the modesty garment is configured for use by a client;

wherein the modesty garment is configured for use with a community shower;

wherein the modesty garment is configured to be worn by the client when in the community shower;

wherein the modesty garment is configured to shield sensitive parts of the client's body from the view of others in the community shower;

wherein the loin wear comprises an anterior panel, a posterior panel, an inferior panel, a waistband, a plurality of leg bands, and a plurality of seams;

wherein the plurality of seams interconnect the anterior panel, the posterior panel, the inferior panel, the waistband, and the plurality of leg bands to assemble the loin wear;

wherein the anterior panel is a portion of the loin wear that is configured to cover anterior and lateral surfaces of a loin region of the client;

wherein the posterior panel is a portion of the loin wear that is configured to cover a posterior and the lateral surfaces of the loin region of the client;

wherein the anterior panel is a sheeting structure;

wherein the anterior panel comprises an anterior panel port;

wherein the anterior panel port is formed in the anterior panel sheeting structure;

wherein the anterior panel is a sheeting structure;

wherein the posterior panel comprises a posterior panel port;

wherein the posterior panel port is formed in the posterior panel sheeting structure;

wherein the anterior panel port comprises an anterior panel port flap, an anterior panel port aperture, an anterior panel port mesh cover, and an anterior panel hook and loop fastener;

wherein the anterior panel port flap is a flap that is formed in the anterior panel sheeting;

wherein the anterior panel port aperture is an aperture that is formed through faces of the anterior panel sheeting;

wherein the anterior panel port flap and the anterior panel port aperture are formed but cutting a slit through the anterior panel sheeting;

wherein the anterior panel port mesh cover forms a netting structure that covers the anterior panel port aperture;

wherein the anterior panel hook and loop fastener is a fastening structure;

wherein the anterior panel hook and loop fastener attaches the anterior panel port flap over the anterior panel port aperture;

wherein the posterior panel port comprises a posterior panel port flap, a posterior panel port aperture, a posterior panel port mesh cover, and a posterior panel hook and loop fastener;

wherein the posterior panel port flap is a flap that is formed in the posterior panel sheeting;

wherein the posterior panel port aperture is an aperture that is formed through faces of the posterior panel sheeting;

wherein the posterior panel port flap and the posterior panel port aperture are formed but cutting a slit through the posterior panel sheeting;

wherein the posterior panel port mesh cover forms a netting structure that covers the posterior panel port aperture;

wherein the posterior panel hook and loop fastener is a fastening structure;

wherein the posterior panel hook and loop fastener attaches the posterior panel port flap over the posterior panel port aperture.

2. The modesty garment according to claim 1
wherein modesty garment is further defined with a navel cover;
wherein the navel cover is configured to be worn by the client;
wherein the navel cover is configured to cover a navel of the client.

3. The modesty garment according to claim 2
wherein the navel cover comprises a collar, a cord, and a medallion;
wherein the cord attaches the collar to the medallion;
wherein the collar is a textile based structure;
wherein the collar has a ring shape;
wherein the collar is configured to fit around the neck of the client;
wherein the collar is configured to secure the cord and the medallion to the client;
wherein the cord is a textile based structure;
wherein the cord suspends the medallion from the collar;
wherein the medallion is a disk-shaped structure;
wherein the medallion is sized such that the medallion is configured to cover the navel of the client;
wherein a length of the cord is selected such that the medallion is configured to hang at a position directly over the navel of the client.

4. The modesty garment according to claim 1
wherein the loin wear is configured to be worn by the client;
wherein the loin wear is configured to cover a loin region of the client.

5. The modesty garment according to claim 1
wherein the anterior panel sheeting structure has a rectilinear shape;
wherein the anterior panel sheeting structure forms the physical structure of the anterior panel that is configured to cover the anterior and lateral surfaces of the loin region of the client;
wherein the anterior panel sheeting structure comprises a first edge, a second edge, a third edge, a fourth edge, a fifth edge, a sixth edge, a seventh edge, and an eighth edge;
wherein the first edge forms a vertex with the eighth edge;
wherein the first edge forms a vertex with the second edge;
wherein the second edge forms a vertex with the third edge;
wherein the third edge forms a vertex with the fourth edge;
wherein the fourth edge forms a vertex with the fifth edge;
wherein the fifth edge forms a vertex with the sixth edge;
wherein the sixth edge forms a vertex with the seventh edge;
wherein the seventh edge forms a vertex with the eighth edge.

6. The modesty garment according to claim 5
wherein the posterior panel sheeting structure has a rectilinear shape;
wherein the posterior panel sheeting structure forms the physical structure of the posterior panel that is configured to cover the posterior and lateral surfaces of the loin region of the client;
wherein the posterior panel sheeting structure comprises a ninth edge, a tenth edge, an eleventh edge, a twelfth edge, a thirteenth edge, a fourteenth edge, a fifteenth edge, and a sixteenth edge;
wherein the ninth edge forms a vertex with the sixteenth edge;
wherein the ninth edge forms a vertex with the tenth edge;
wherein the tenth edge forms a vertex with the eleventh edge;
wherein the eleventh edge forms a vertex with the twelfth edge;
wherein the twelfth edge forms a vertex with the thirteenth edge;
wherein the thirteenth edge forms a vertex with the fourteenth edge;
wherein the fourteenth edge forms a vertex with the fifteenth edge;
wherein the fifteenth edge forms a vertex with the sixteenth edge.

7. The modesty garment according to claim 6
wherein the anterior panel port has an open position and a closed position;
wherein in the open position, the anterior panel port aperture allows for flow of water into the loin wear;
wherein the water that flows through the anterior panel port is configured to flow over the anterior and lateral surfaces of the loin region of the client.

8. The modesty garment according to claim 7
wherein the posterior panel port has an open position and a closed position;
wherein in the open position, the posterior panel port aperture allows for the flow of water into the loin wear;
wherein the water that flows through the posterior panel port is configured to flow over the posterior and lateral surfaces of the loin region of the client.

9. The modesty garment according to claim 8
wherein the anterior panel port flap is formed in the shape of a semi-circle;
wherein the anterior panel port aperture is formed in the shape of a semi-circle;
wherein the anterior panel port flap blocks visibility through the anterior panel port aperture;
wherein the anterior panel port flap blocks the visibility through the anterior panel port aperture when the anterior panel sheeting is in the closed position;
wherein the anterior panel port flap folds away from the anterior panel port aperture when the anterior panel sheeting is in the open position;
wherein the anterior panel port flap further comprises an anterior panel port living hinge and a first raw edge;
wherein the anterior panel port aperture further comprises a second raw edge;
wherein the anterior panel port living hinge is a physical connection that leaves the anterior panel port flap attached to the anterior panel sheeting such that the anterior panel port flap can rotate relative to the anterior panel sheeting;
wherein the first raw edge is the raw edge of the slit that forms the anterior panel port that forms the perimeter of the anterior panel port aperture;
wherein the second raw edge is the raw edge of the slit that forms the anterior panel port that forms the perimeter of the anterior panel port flap;
wherein the anterior panel port mesh cover is a mesh textile;
wherein the anterior panel port mesh cover is cut in the shape of a semi-circle;
wherein the anterior panel port mesh cover is geometrically similar to the anterior panel port flap and the anterior panel port aperture;

wherein the anterior panel port mesh cover prevents solid objects from falling into the loin wear when the loin wear is in the open position;

wherein the anterior panel port mesh cover further comprises a twenty-first edge and a twenty-second edge;

wherein the twenty-first edge is the linear edge of the anterior panel port mesh cover;

wherein the twenty-second edge is the curved edge of the anterior panel port mesh cover.

10. The modesty garment according to claim 9 wherein the posterior panel port flap is formed in the shape of a semi-circle;

wherein the posterior panel port aperture is formed in the shape of a semi-circle;

wherein the posterior panel port flap blocks visibility through the posterior panel port aperture;

wherein the posterior panel port flap blocks the visibility through the posterior panel port aperture when the posterior panel sheeting is in the closed position;

wherein the posterior panel port flap folds away from the posterior panel port aperture when the posterior panel sheeting is in the open position;

wherein the posterior panel port flap further comprises a posterior panel port living hinge and a third raw edge;

wherein the posterior panel port aperture further comprises a fourth raw edge;

wherein the posterior panel port living hinge is a physical connection that leaves the posterior panel port flap attached to the posterior panel sheeting such that the posterior panel port flap can rotate relative to the posterior panel sheeting;

wherein the third raw edge is the raw edge of the slit that forms the posterior panel port that forms the perimeter of the posterior panel port aperture;

wherein the fourth raw edge is the raw edge of the slit that forms the posterior panel port that forms the perimeter of the posterior panel port flap;

wherein the posterior panel port mesh cover is a mesh textile;

wherein the posterior panel port mesh cover is cut in the shape of a semi-circle;

wherein the posterior panel port mesh cover is geometrically similar to the posterior panel port flap and the posterior panel port aperture;

wherein the posterior panel port mesh cover prevents solid objects from falling into the loin wear when the loin wear is in the open position;

wherein the posterior panel port mesh cover further comprises a twenty-third edge and a twenty-fourth edge;

wherein the twenty-third edge is the linear edge of the posterior panel port mesh cover;

wherein the twenty-fourth edge is the curved edge of the posterior panel port mesh cover.

11. The modesty garment according to claim 10 wherein the inferior panel is a mesh textile based sheeting structure;

wherein the inferior panel is the portion of the loin wear that is configured to cover inferior surfaces of the loin region of the client;

wherein the mesh textile based sheeting structure of the inferior panel is configured to allow water to flow freely out of the loin wear during a shower;

wherein the inferior panel further comprises a seventeenth edge, an eighteenth edge, a nineteenth edge, and a twentieth edge; wherein the seventeenth edge forms a vertex with the twentieth edge;

wherein the seventeenth edge forms a vertex with the eighteenth edge;

wherein the eighteenth edge forms a vertex with the nineteenth edge;

wherein the nineteenth edge forms a vertex with the twentieth edge.

12. The modesty garment according to claim 11 wherein the waistband is a textile based webbing structure;

wherein the waistband has a quick cord structure; wherein the waistband is configured to bind the loin wear to the client;

wherein the waistband further comprises a first end and a second end;

wherein the first end is an edge of the waistband with the least span of length;

wherein the second end is an edge of the waistband that is distal from the first end.

13. The modesty garment according to claim 12 wherein each of the plurality of leg bands is a textile based elastic webbing structure;

wherein each of the plurality of leg bands attaches to the anterior panel, the posterior panel, and the inferior panel;

wherein the plurality of leg bands is configured to bind the loin wear to first and second legs of the client;

wherein the elastic webbing structure of the plurality of leg bands comprises a first elastic webbing and a second elastic webbing;

wherein the first elastic webbing is configured to secure the loin wear to the first leg of the client;

wherein the second elastic webbing is configured to secure the loin wear to the second leg of the client;

wherein the first elastic webbing further comprises a third end and a fourth end;

wherein the second elastic webbing further comprises a fifth end and a sixth end;

wherein the third end is an edge of the first elastic webbing with the least span of length;

wherein the fourth end is an edge of the first elastic webbing that is distal from the third end;

wherein the fifth end is an edge of the second elastic webbing with the least span of length;

wherein the sixth end is an edge of the second elastic webbing that is distal from the fifth end.

14. The modesty garment according to claim 13 wherein each of the plurality of seams forms an attachment that is used to assemble the anterior panel, the posterior panel, the inferior panel, the waistband, and the plurality of leg bands into the loin wear;

wherein the plurality of seams comprises a first seam, a second seam, a third seam, a fourth seam, a fifth seam, a sixth seam, a seventh seam, an eighth seam, a ninth seam, a tenth seam, an eleventh seam, a twelfth seam, a thirteenth seam, and a fourteenth seam;

wherein the first seam is a sewn seam;

wherein the first seam attaches the anterior panel to the posterior panel;

wherein the second seam is a sewn seam;

wherein the second seam attaches the anterior panel to the posterior panel;

wherein the third seam is a sewn seam;

wherein the third seam attaches the inferior panel to the anterior panel and the posterior panel;

wherein the fourth seam is a sewn seam;

wherein the fourth seam attaches the inferior panel to the anterior panel and the posterior panel;

wherein the fifth seam is a sewn seam;
wherein the fifth seam attaches the anterior panel port to the anterior panel;
wherein the sixth seam is a sewn seam;
wherein the sixth seam attaches the posterior panel port to the posterior panel;
wherein the seventh seam is a sewn seam;
wherein the seventh seam attaches the waistband to the anterior panel and the posterior panel;
wherein the eighth seam is a sewn seam;
wherein the eighth seam attaches the inferior panel to the anterior panel and the posterior panel;
wherein the ninth seam is a sewn seam;
wherein the ninth seam attaches the inferior panel to the anterior panel and the posterior panel;
wherein the tenth seam is a sewn seam;
wherein the tenth seam attaches the first elastic webbing to the anterior panel and the posterior panel;
wherein the eleventh seam is a sewn seam;
wherein the eleventh seam attaches the second elastic webbing to the anterior panel and the posterior panel;
wherein the twelfth seam is a sewn seam;
wherein the twelfth seam attaches the waistband to itself to form a loop;
wherein the thirteenth seam is a sewn seam;
wherein the thirteenth seam attaches the first elastic webbing to itself to form a loop;
wherein the fourteenth seam is a sewn seam;
wherein the fourteenth seam attaches the second elastic webbing to itself to form a loop.

15. The modesty garment according to claim 14 wherein the first seam attaches the eighth edge of the anterior panel sheeting to the sixteenth edge of the posterior panel sheeting;
wherein the second seam attaches the second edge of the anterior panel sheeting to the tenth edge of the posterior panel sheeting;
wherein the third seam attaches the nineteenth edge of the inferior panel to the fourth edge of the anterior panel sheeting;
wherein the third seam attaches the nineteenth edge of the inferior panel to the fifth edge of the anterior panel sheeting;
wherein the third seam attaches the nineteenth edge of the inferior panel to the sixth edge of the anterior panel sheeting;
wherein the fourth seam attaches the seventeenth edge of the inferior panel to the twelfth edge of the posterior panel sheeting;
wherein the fourth seam attaches the seventeenth edge of the inferior panel to the thirteenth edge of the posterior panel sheeting;
wherein the fourth seam attaches the seventeenth edge of the inferior panel to the fourteenth edge of the posterior panel sheeting;
wherein the fifth seam attaches the anterior panel port mesh cover to the first raw edge of the anterior panel port aperture;
wherein the sixth seam attaches the posterior panel port mesh cover to the third raw edge of the posterior panel port aperture;
wherein the seventh seam attaches the waistband to the first edge of the anterior panel sheeting;
wherein the seventh seam attaches the waistband to the ninth edge of the anterior panel sheeting;
wherein the eighth seam attaches the twentieth edge of the inferior panel to the seventh edge of the anterior panel sheeting;
wherein the eighth seam attaches the twentieth edge of the inferior panel to the fifteenth edge of the posterior panel sheeting;
wherein the ninth seam attaches the eighteenth edge of the inferior panel to the third edge of the anterior panel sheeting;
wherein the ninth seam attaches the eighteenth edge of the inferior panel to the eleventh edge of the posterior panel sheeting;
wherein the tenth seam attaches the first elastic webbing to the seventh edge of the anterior panel sheeting;
wherein the tenth seam attaches the first elastic webbing to the fifteenth edge of the posterior panel sheeting;
wherein the eleventh seam attaches the second elastic webbing to the third edge of the anterior panel sheeting;
wherein the eleventh seam attaches the second elastic webbing to the eleventh edge of the posterior panel sheeting;
wherein the twelfth seam attaches the first end of the waistband to the second end of the waistband;
wherein the thirteenth seam attaches the third end of the first elastic webbing to the fourth end of the first elastic webbing;
wherein the fourteenth seam attaches the fifth end of the second elastic webbing to the sixth end of the second elastic webbing.

* * * * *